US005967378A

United States Patent [19]

Arispe

[11] Patent Number: 5,967,378

[45] Date of Patent: Oct. 19, 1999

[54] BEVERAGE CONTAINER PITCHER AND METHOD

[76] Inventor: David M. Arispe, 3016 Tew St., Greensboro, N.C. 27407-7648

[21] Appl. No.: 09/020,114

[22] Filed: Feb. 6, 1998

[51] Int. Cl.[6] ..... B67D 5/06

[52] U.S. Cl. ..... 222/183; 222/465.1; 220/737

[58] Field of Search ..... 222/131, 183, 222/465.1; 220/737, 759, 710.5; 215/386

[56] References Cited

U.S. PATENT DOCUMENTS

| | | | |
|---|---|---|---|
| 1,935,969 | 11/1933 | Witherspoon | 222/183 |
| 2,262,273 | 11/1941 | Ferrara | 220/759 |
| 2,936,927 | 5/1960 | Peters | 220/737 |
| 3,096,911 | 7/1963 | Finch et al. | 222/183 |
| 4,239,130 | 12/1980 | Altadonna | 222/131 |
| 5,799,811 | 9/1998 | Bruckner et al. | 215/386 |

OTHER PUBLICATIONS

Quadro label, Luminarc, 1989.

*Primary Examiner*—Philippe Derakshani

[57] ABSTRACT

This invention is directed to a pitcher which securely holds a conventional drink beverage container, such as a soft drink bottle, therein by frictional engagement within the pitcher and the use of an optional annular collar around the drink bottle. A cap grip is provided which facilitates the removal of the cap of the drink bottle by arthritic individuals. A method for using the pitcher is also included.

4 Claims, 9 Drawing Sheets

BEVERAGE CONTAINER PITCHER AND METHOD

BACKGROUND OF THE INVENTION

1. Field of the Invention

This invention pertains to a pitcher which is well suited to hold conventional commercial bottles and cartons for ease and convenience in pouring liquid therefrom.

2. Description of The Prior Art And Objectives Of The Invention

Arthritic individuals and children frequently have trouble manually manipulating commercially available beverage containers, specifically smooth walled cylindrical bottles common to the soft drink industry, or the equally smooth square cartons as used in the juice industries. Similarly, threaded caps, such as those commonly found on soft drink bottles, are difficult to remove with arthritic or injured hands.

Conventional thermoses with or without handles can be used by arthritic people to store beverages, but often create problems by allowing the beverage to "go flat." "Cozies" or other usual snug can containers also fail to address the above enumerated concerns because such devices likewise have smooth side walls and are thus difficult to grip by arthritic or other individuals with little manual dexterity.

With these concerns in mind, it is an objective of the present invention to provide a handled pitcher which is well suited to hold a generally cylindrical drink bottle therein.

It is a further objective of the present invention to provide a pitcher which can hold a drink bottle or carton or utilize an auxiliary pour spout in a detachable lid.

It is still a further objective of the present invention to provide a rectangular pitcher which is well suited to hold conventional large juice cartons.

It is yet a further objective of the present invention to provide a pitcher which includes a winged cap grip which facilitates the removal of a drink bottle cap.

It is another objective to provide a number of differently shaped pitchers so as to accommodate different sized or shaped drink bottles or cartons.

It is yet another objective to provide a pitcher with ridges on the interior which facilitate the insertion and removal of drink bottle or carton from the pitcher.

It is still another objective to provide a method of using a pitcher which implements the advantages set forth herein.

SUMMARY OF THE INVENTION

These objectives and advantages are realized by a pitcher formed from a substantially rigid, preferably polymeric material. The pitcher includes a primary cup-like section or vessel sized appropriately to receive a beverage container such as a drink bottle, carton, or beverage therein. A generally trapezoidal base is preferably attached to the vessel to provide additional stability for the pitcher when it placed on a planar surface such as a table. An oversized handle is attached to the vessel which an adult may easily grasp to lift or manipulate the pitcher, although certainly smaller hands such as a child's would be able to effectively manipulate the same. The pitcher preferably includes a plurality of ridges on the inside of the vessel which frictionally engage the sides of drink bottle inserted therein. An optional collar is releasably affixed to the pitcher to hold the drink bottle in the pitcher.

The pitcher may also be used in the standard manner wherein the drink bottle may be replaced by a detachable lid and fluid poured directly into the pitcher. Such is not preferred, but is contemplated.

The pitcher may be generally conical, either in a square or cylindrical configuration and made without the interior ridges. This is not the preferred embodiment, but is within the scope of the invention. The preferred pitcher comes with a winged cap grip which is also preferably polymeric. The cap grip may be sized so as to fit over a conventional soft drink bottle cap and frictionally engage the same. However, the preferred cap grip is sized so as to replace the manufacturer's cap. The oversize wings allow someone with limited hand strength or dexterity to manipulate the cap easily to thereby remove or replace the cap on the bottle.

The method of using the pitcher of the present invention comprises placing the pitcher on a planar surface such as a table top and removing the lid or the collar of the present invention. Once removed, a drink bottle, such as a standard two liter soft drink bottle is placed in the pitcher. The annular collar, if used, is affixed to the pitcher, around the drink bottle. The drink bottle is then manually decapped such as through the use of the cap grip. The handle is then grasped and beverage poured from the drink bottle into a cup or the like.

DETAILED DESCRIPTION OF THE PREFERRED EMBODIMENT AND OPERATION OF THE INVENTION

Figure 1:
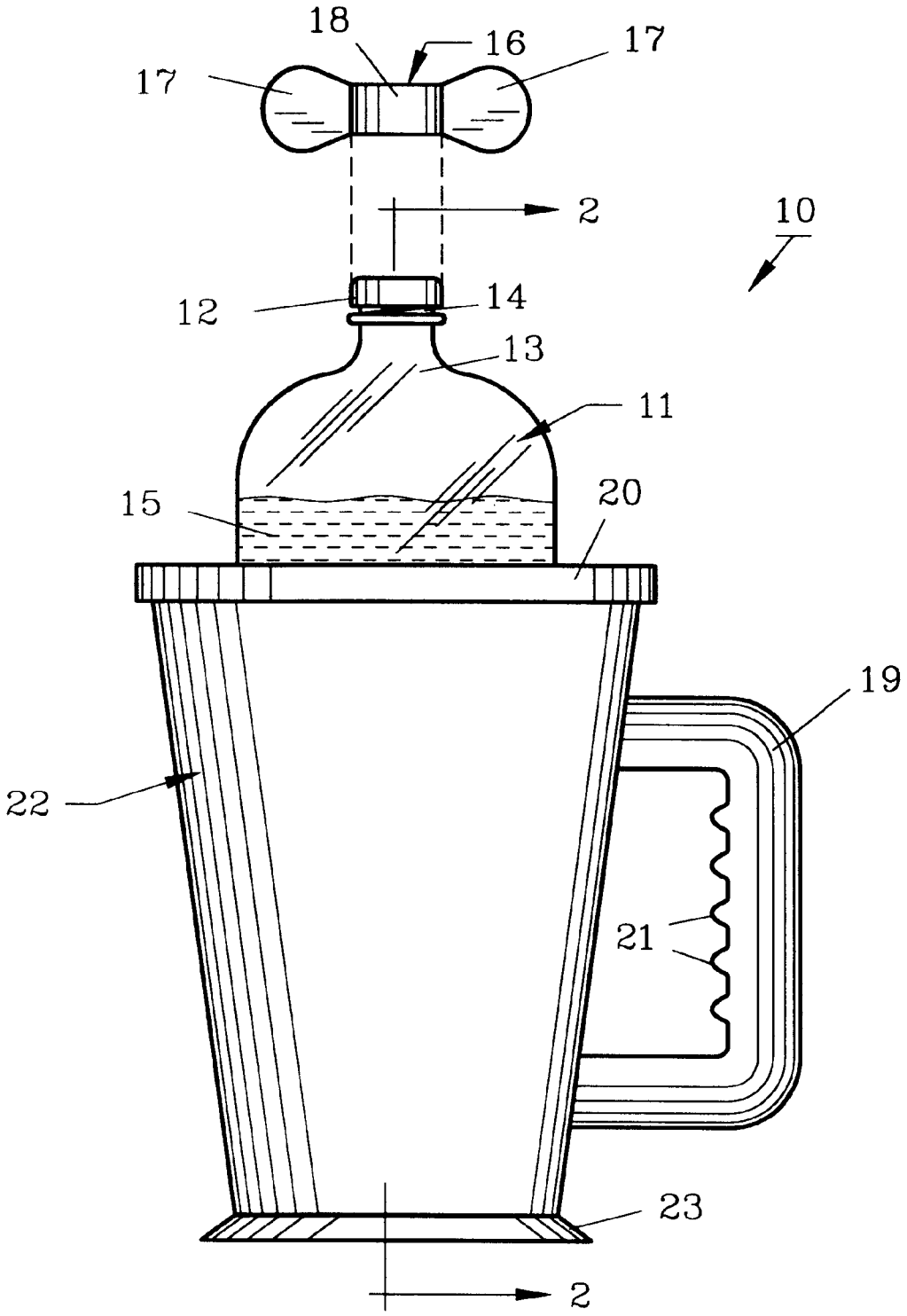
FIG. 1 shows a side elevational view of an embodiment of the present invention which is suited for a cylindrical drink bottle.

Turning now to the drawings, specifically FIGS. 1–4 show a first embodiment of the present invention. Specifically pitcher 10 includes generally cylindrically conical cup-like section or vessel 22 attached to generally trapezoidal base 23. Handle 19 is preferably integrally formed with vessel 22 and includes ridges 21 which provide additional frictional surfaces for a human hand (not shown) to grasp by increasing the surface area that the hand contacts. Handle 19 is preferably slightly oversized so as to easily allow an adult human hand to manipulate handle 19 even where the hand may have difficulty closing due to arthritis or the like, although other sizes are certainly possible. Pitcher 10 is preferably an opaque polymeric material and indicia (not shown) may be displayed thereon, but transparent polymers are possible as are other materials including but not limited to glass, wood or metal, but such are not preferred for cost, weight or other concerns.

Figure 14:
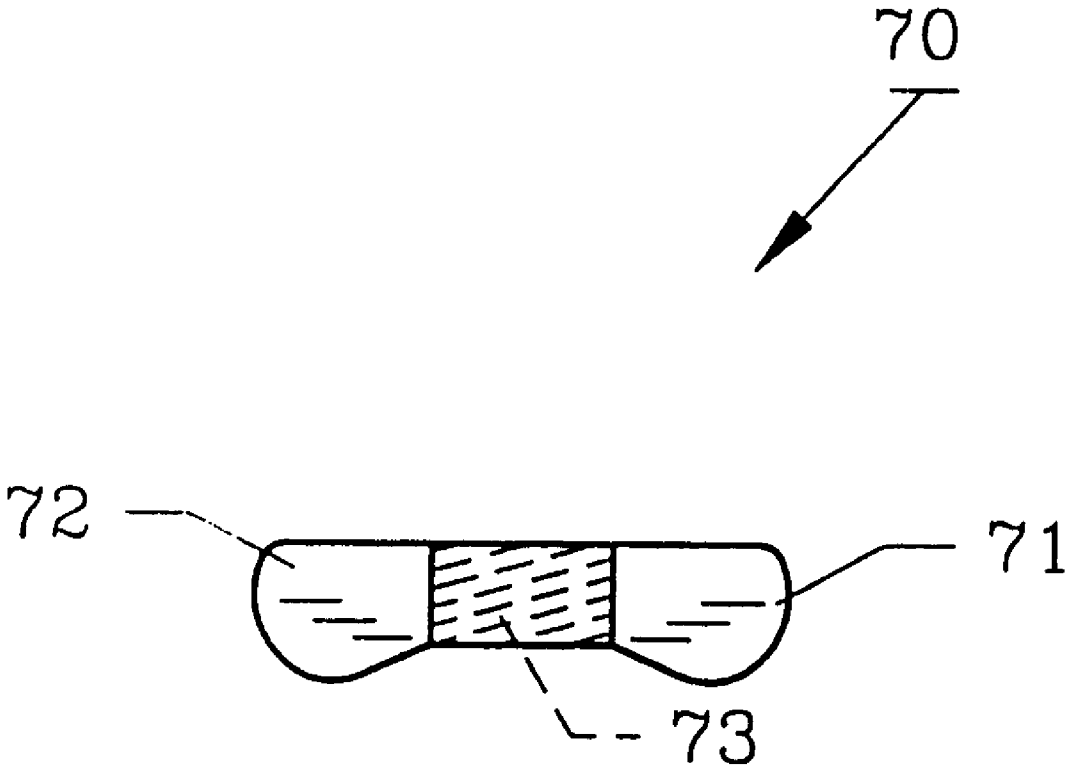
FIG. 14 demonstrates the preferred cap grip with interior threads.

Located within pitcher 10 is a beverage container or bottle such as drink bottle 11, which can be a two or three liter conventional drink bottle, such as are common in the soft drink industry. Bottle 11 is typically transparent and includes neck 13 and threads 14 which threadably, releasably attach cap 12 to bottle 11 as is conventional. Bottle 11 contains fluid 15, such as a soft drink beverage, therein as is well understood. Cap grip 16 includes oversize wings 17 and main portion 18. Main portion 18 is sized so as to fit over cap 12 and frictionally engage the same. Wings 17 allow a user to more easily manipulate cap 12 by providing additional leverage surfaces by which a user may turn cap grip 16 and thus cap 12 to remove or position cap 12 on bottle 11. The process of removing cap 12 from bottle 11 will herein be referred to as decapping. In FIG. 14, cap grip 70 may be sized and threaded so as to completely replace cap 12. Cap 70 includes oversize wings 71 and 72 and interior threads 73 for such an arrangement. While preferred, such a cap grip should be washed between uses to maintain sanitary conditions.

Figure 2:
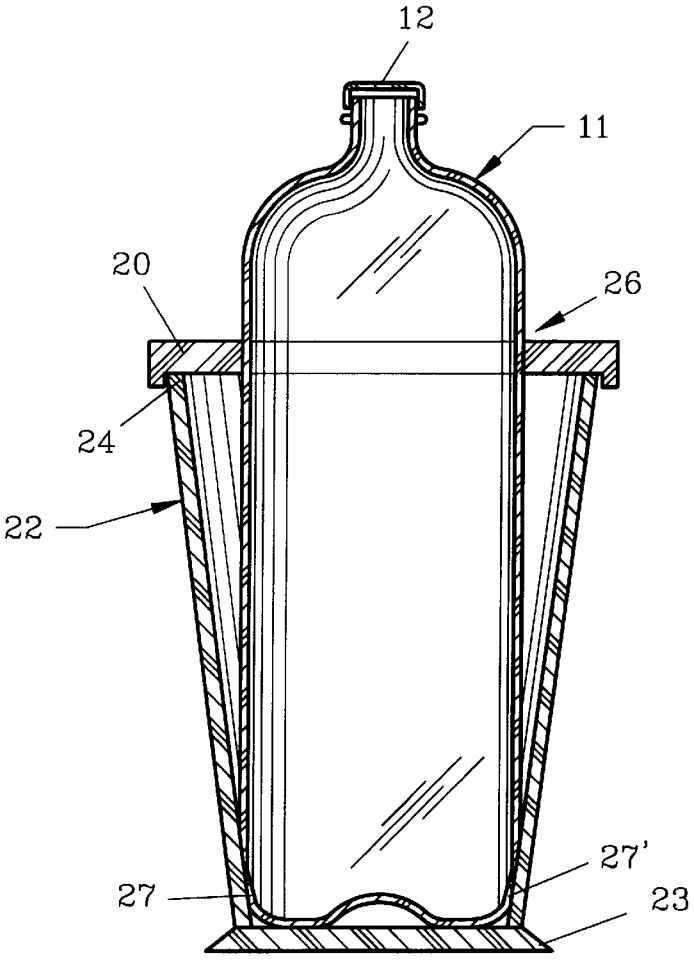
FIG. 2 illustrates a cross sectional view of the device along lines 2—2 of FIG. 1.
Figure 3:
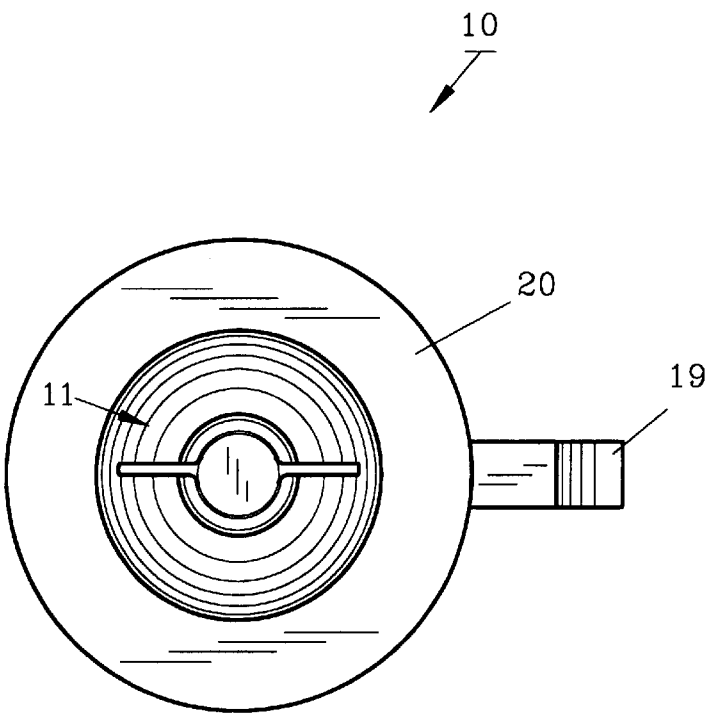
FIG. 3 demonstrates a top elevational view of the device of FIG. 1.
Figure 4:
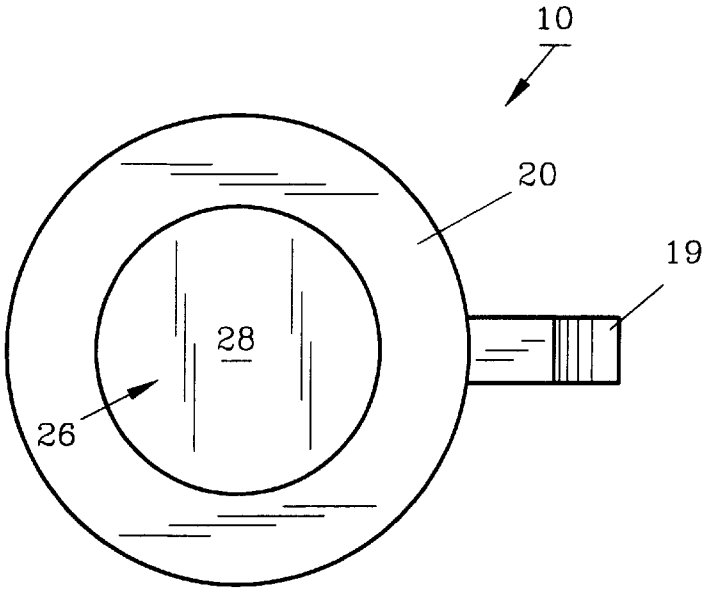
FIG. 4 features a top elevational view of the device of FIG. 1 with the drink bottle removed.

As better seen in FIGS. 2–4, collar 20 fits over upper lip 24 of pitcher 10 and frictionally engages the same. Upper lip 24 may include a ridge (not shown) to increase the pressure fit between collar 20 and pitcher 10. Collar 20 is annular and sized so as to allow a two liter bottle to pass through hole 26 defined by annular collar 20. Pitcher 10 is sized so that side wall portions 27 and 27' fit snugly against bottle 11. It should be understood that all sides of bottle 11 are so held, but the cross sectional view only shows the two points of contact labeled 27 and 27'. Between the engagement at side wall portions 27 and 27' and collar 20, bottle 11 is securely held within pitcher 10. Collar 20 is preferably made from the same material that pitcher 10 is. Obvious size readjustments would be made to accommodate a three liter bottle, but the structure would remain the same. In FIG. 4, with bottle 11 removed, upper surface 28 of base 23 is seen through hole 26 of annular collar 20.

Figure 6:
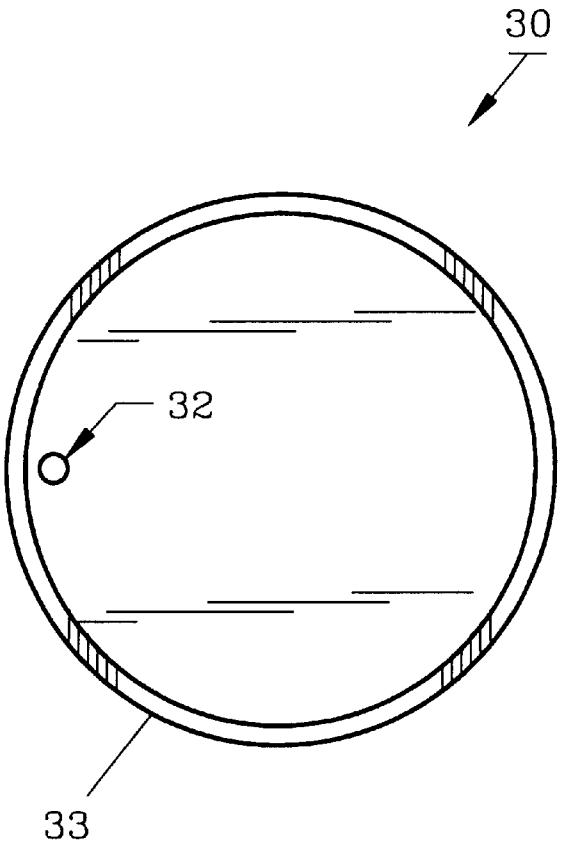
FIG. 6 shows a bottom elevational view of the lid of FIG. 5.
Figure 5:
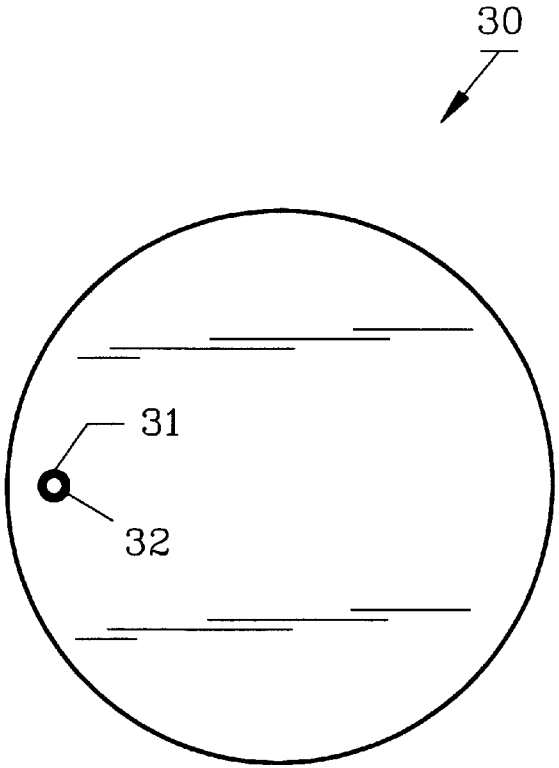
FIG. 5 pictures a top elevational view of the preferred lid of the present invention.
Figure 7:
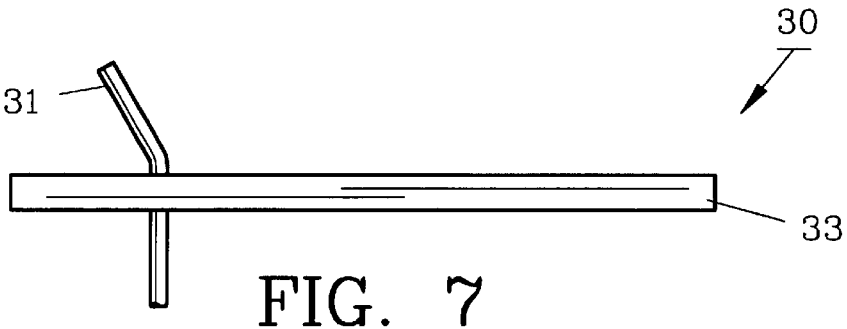
FIG. 7 features a side elevational view of the lid of FIG. 5.

Pitcher 10 may also be used more conventionally as a normal pitcher with the removal of bottle 11 and collar 20. In their place, lid 30 as seen in FIGS. 5–7 may be used. Lid 30 includes pour spout 31 which extends through hole 32 defined by lid 30. Lid 30 is preferably polymeric as sized so as to fit over upper lip 24 (FIG. 2) of pitcher 10 where lip 33 engages upper lip 24 of pitcher 10. In the event a ridge is present on upper lip 24 the pressure fit between lid 30 and pitcher 10 is more securely created.

Figure 8:
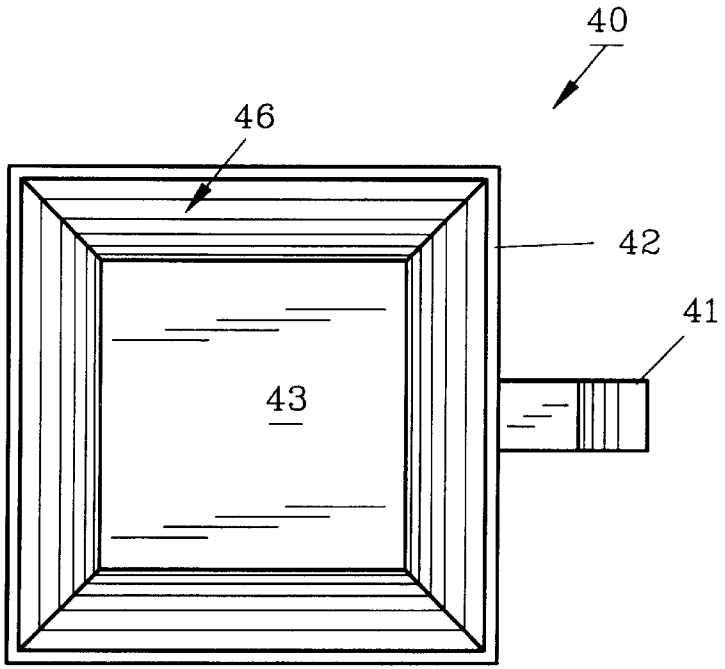
FIG. 8 illustrates a top elevational view of an alternate rectangularly conical embodiment of the present invention, with drink bottle and collar removed.
Figure 9:
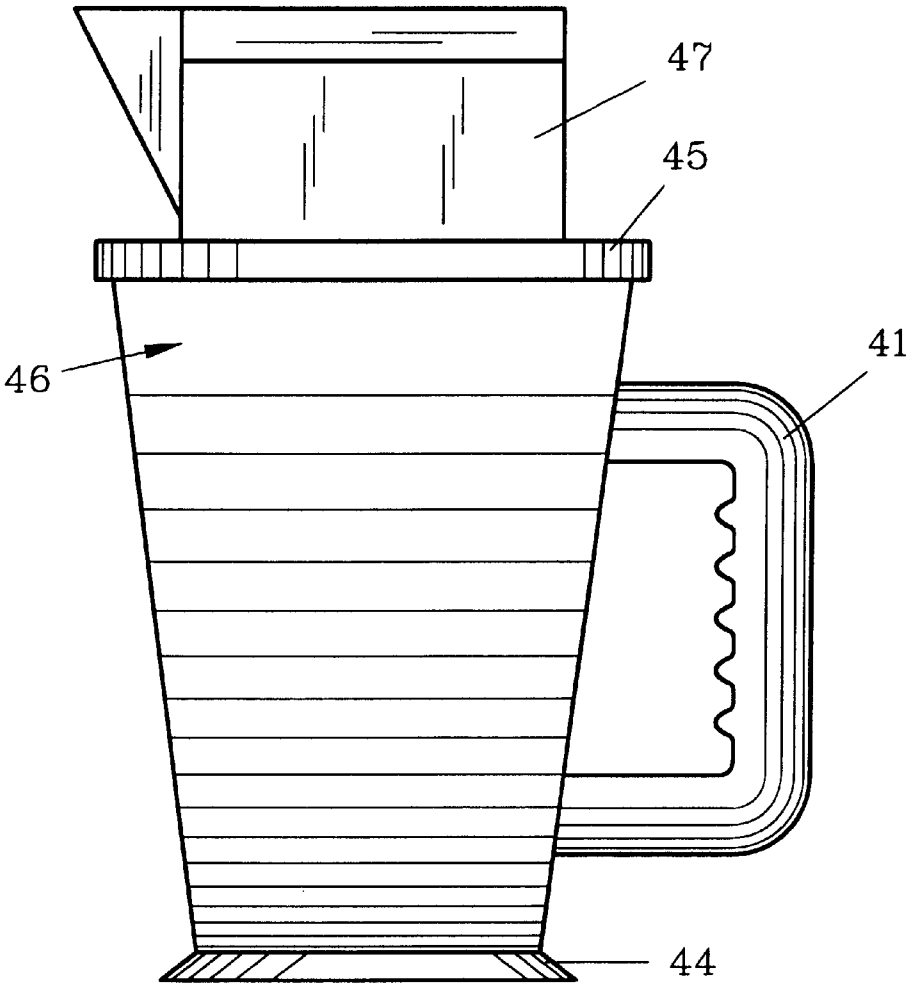
FIG. 9 demonstrates a side elevational view of the embodiment of FIG. 8, with drink bottle and collar in place.

A second embodiment is seen in FIGS. 8 and 9 where pitcher 40 is seen. Pitcher 40 is generally rectangularly conical and includes oversized handle 41 and upper lip 42. Pitcher 40 is well adapted to receive square drink bottle or carton 47—such as are commonly found in the juice industry—within vessel 46. Herein the term bottle is specifically defined to include conventional beverage containers such as bottle 11 and carton 47 and their equivalents. Carton 47 rests on planar surface 43 of base 44 and is held in place by square annular collar 45, much as collar 20 held bottle 11 in place. Vessel 46 is sized so that the sides of carton 47 are held by the lower portions of vessel 46 much as bottle 11 is held by side wall portions 27 and 27'.

Figure 11:
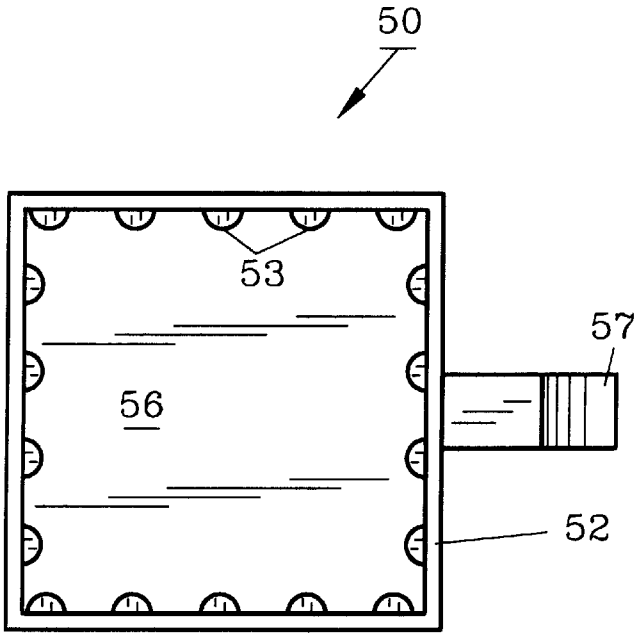
FIG. 11 pictures a top elevational view of the pitcher of FIG. 10 with the drink carton removed.
Figure 10:
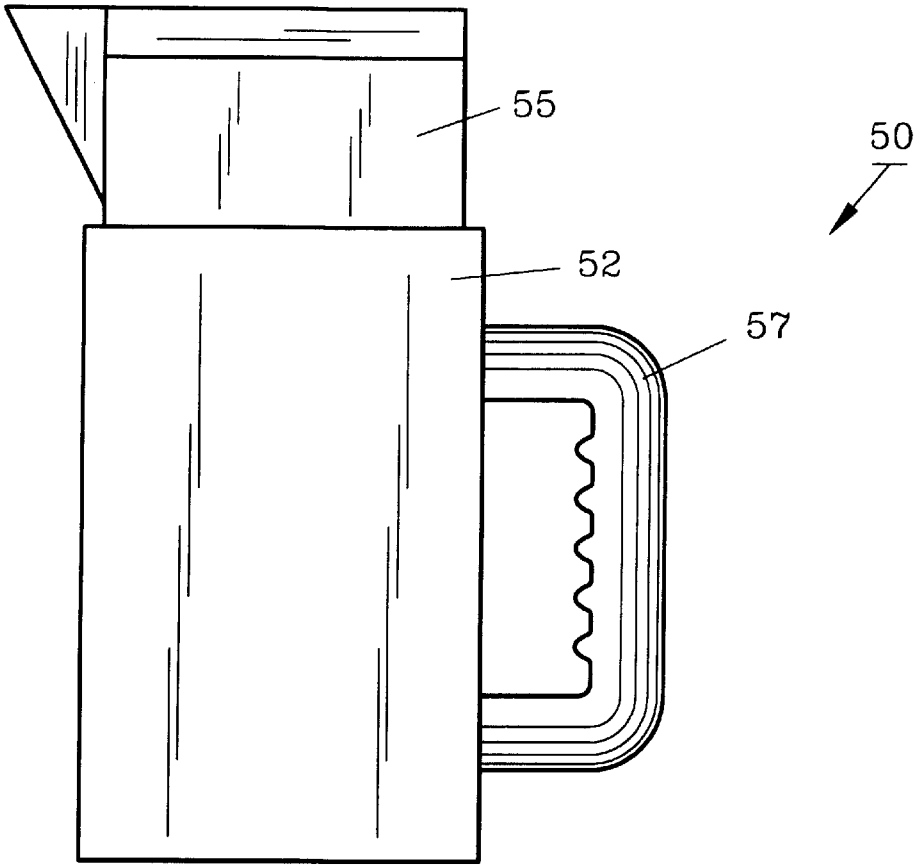
FIG. 10 features a side elevational view of the preferred rectangular embodiment of the present invention.

Preferred rectangular pitcher 50 is seen in FIGS. 10 and 11. Pitcher 50 includes handle 51 and rectangular, non-cylindrical, non-conical vessel 52. The interior of vessel 52 includes plurality of ridges 53 which frictionally engage rectangular bottle 55, which may be a juice carton, and hold bottle 55 in place. Ridges 53 are spaced one from the other in order to prevent a vacuum from forming when bottle 55 is drawn out from vessel 52. A base (not shown) similar to base 23 or 44 may also be attached to pitcher 50. Surface 56 is generally planar and supports bottle 55 as is well understood. In this embodiment, a collar such as collar 45 may be used, but is not required, since ridges 53 provide sufficient frictional engagement to hold bottle 55 in place.

Figure 13:
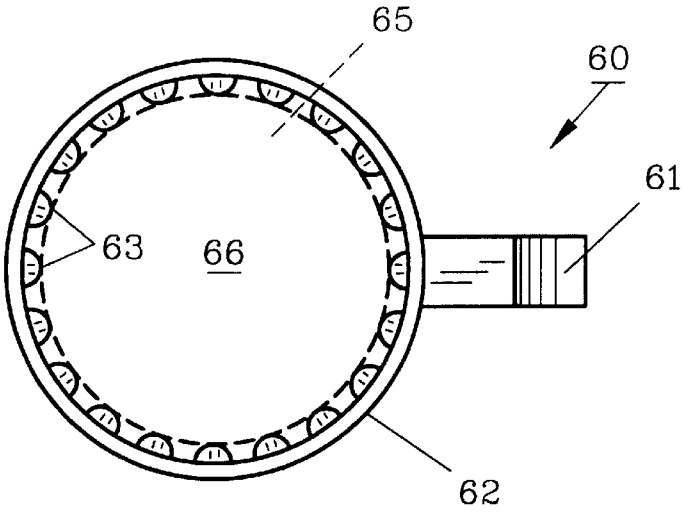
FIG. 13 shows a top elevational view of the pitcher of FIG. 12 with the bottle dotted in place.
Figure 12:
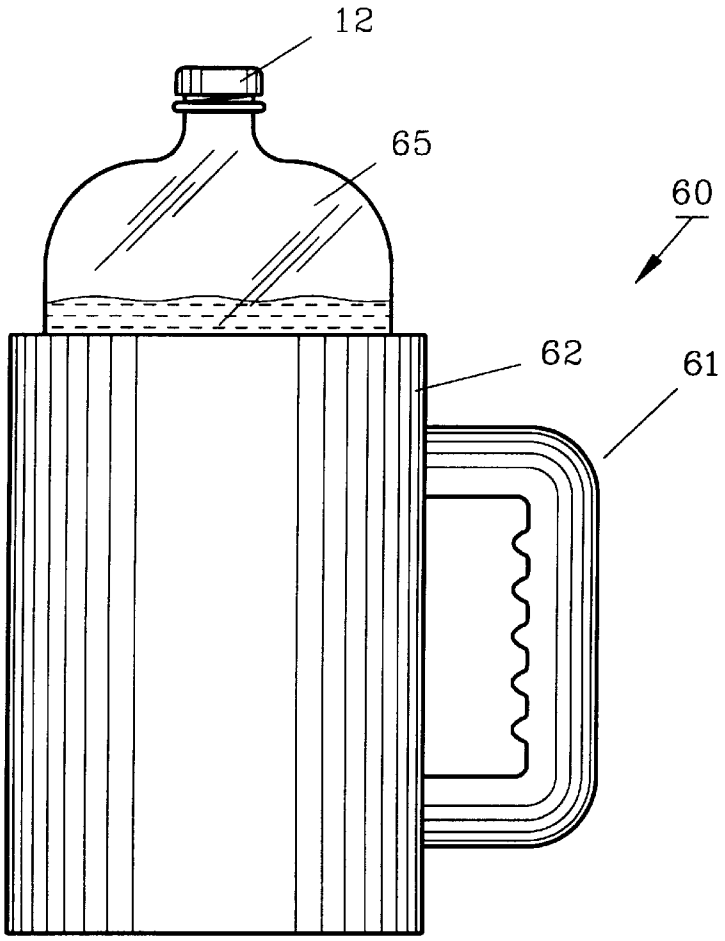
FIG. 12 depicts a side elevational view of the preferred cylindrical embodiment of the present invention.

Preferred cylindrical pitcher 60 is seen in FIGS. 12 and 13. Pitcher 60 is substantially identical in function to pitcher 50 but is generally cylindrical with non-angled walls to create a non-conical vessel 62 for use with cylindrical bottle 65. Pitcher 60 also includes handle 61. Vessel 62 includes ridges 63 space bottle 65 from the walls of vessel 62 and prevent vacuum formation. Again, an annular collar, such as collar 20 may be used to provide additional securing means for bottle 65. It should be noted that bottle 65 rests on planar surface 66 of pitcher 60, and as dotted in FIG. 13, clearly abuts ridges 63.

The preferred method of using pitchers 10, 40, 50, or 60 is identical and for simplicity will be discussed in terms of pitcher 60 with the understanding that a simple substitution is possible. Pitcher 60 is placed on a planar surface such as a table top and lid 30 or collar 64 is removed. Bottle 65 is placed within pitcher 60 and forced downwardly until bottle 65 rests on planar surface 66. Then, collar 64 is placed around bottle 65 and affixed to pitcher 60. Collar 64 and ridges 63 securely hold bottle 65 within pitcher 60. Cap grip 16 is then placed on cap 12 of bottle 65. The user then manipulates cap grip 16 via wings 17 in order to open or decap bottle 65. Handle 61 is manipulated so that beverage or fluid 15 is poured from bottle 65 without the need to actually grip bottle 65 and its smooth outer walls. Bottle 65 is then closed by using cap grip 16 to put cap 12 back on bottle 65.

An alternate method includes opening bottle 65 with or without cap grip 16 and pouring fluid 15 into pitcher 60. Lid 30 or its equivalent is then positioned over pitcher 60 and fluid or beverage 15 is poured from spout 31 much as with a conventional pitcher.

The preceding recitation is provided as an example of the preferred embodiment and is not meant to limit the nature or scope of the present invention.

I claim:

1. A method of utilizing a beverage container in combination with a pitcher, said method comprising the steps of:

a) placing a beverage container in said pitcher;

b) positioning a collar around said beverage container while affixing said collar to said pitcher;

c) placing a cap grip with wings on said beverage container;

d) decapping said beverage container; and e) pouring fluid from said beverage container by tilting said pitcher.

2. The method of claim 1 wherein pouring fluid from said beverage container comprises the step of tilting said pitcher by manual manipulation.

3. The method of claim 1 wherein pouring fluid from said beverage container comprises the step of grasping a handle on said pitcher and manipulating said handle.

4. The method of claim 1 wherein positioning a collar around said beverage container leaves a portion of said beverage container exposed above said collar.

* * * * *